United States Patent [19]

Fethke et al.

[11] 4,179,029

[45] Dec. 18, 1979

[54] FUNCTIONAL BLISTER PACKAGE FOR SNIPPER-TYPE SCISSORS

[75] Inventors: Wayne G. Fethke, Wausau; Paul C. Mayer, Rothschild, both of Wis.

[73] Assignee: Fiskars Manufacturing Corporation, Wausau, Wis.

[21] Appl. No.: 911,546

[22] Filed: Jun. 1, 1978

[51] Int. Cl.[2] ..... B65D 73/00; B65D 85/00

[52] U.S. Cl. ..... 206/349; 206/461; 206/471

[58] Field of Search ..... 30/125, 143, 151, 154–155, 30/231–233; 206/349, 461–465, 467–468, 470, 471

[56] References Cited

U.S. PATENT DOCUMENTS

| | | | |
|---|---|---|---|
| 3,891,088 | 6/1975 | Huebner | 206/349 |
| 3,972,417 | 8/1976 | Iten et al. | 206/461 X |

FOREIGN PATENT DOCUMENTS

| | | | |
|---|---|---|---|
| 2444606 | 4/1976 | Fed. Rep. of Germany | 206/349 |
| 2509491 | 9/1976 | Fed. Rep. of Germany | 206/349 |
| 1242088 | 8/1971 | United Kingdom | 206/461 |

*Primary Examiner*—Stephen Marcus

*Attorney, Agent, or Firm*—Ladas, Parry, Von Gehr, Goldsmith & Deschamps

[57] ABSTRACT

A functional blister package for snipper-type scissors comprising a display card; a transparent, flexible, blistered elongated covering; an outwardly bent edge on the transparent covering facing the display card and made to adhere to said card; the transparent covering being generally shaped to conform to the shape of the snippers; one end of the generally elongated transparent covering being shaped to closely embrace and lock in place the U-shaped handle of the snippers; the other end of the transparent covering being trapezoidal in shape to permit restricted movement of the blades; and a cut-out portion in the transparent blistered covering substantially midway between said ends and allowing the finger or thumb loop of the snipper to project outside so as to permit the snippers to be grasped and tested by the prospective purchaser.

1 Claim, 6 Drawing Figures

FUNCTIONAL BLISTER PACKAGE FOR SNIPPER-TYPE SCISSORS

This invention relates to blister packages for snipper-type scissors.

BACKGROUND OF THE INVENTION

Quality scissors are customarily sold mounted on a display card which carries the name of the maker, distributor and/or marketer and other advertising material. The card and the major part of the scissors are enclosed in a transparent plastic envelope which protects the scissors and display card during storage. The scissors are retained in place by a plastic loop passing over one of the handles. These plastic envelopes have to be slipped by hand over the display card, the loops have to be individually placed around the handle and riveted to the card. This manual assembly is time-consuming and increases the overall production costs.

Blister packages have been known for some time and it is quite customary to mount small items of hardware, stationery, notions and so on on a display card under a blister made of transparent, stiff, but flexible material such as polyvinyl chloride (PVC) and applied by heat and pressure-adhesive means. These known "blisters" completely enclose the article of merchandise and it is impossible for the purchaser to touch or test the article without destroying the "blister".

It is the principal object of the invention to provide a functional blister package for snipper-type scissors so as to enable the purchaser to grasp the snippers and test-operate them within the confines of the blister.

It is the further object of the invention to provide a blister package for a pair of snippers which can be applied by machine in an automated assembly line.

Another object of the invention is to provide a blister package which permanently houses and displays a pair of snippers, yet is partially open so that the snippers can be grasped by the prospective purchaser who wants to get the "feel" of the handle test the movement and function of the blades.

DETAILED DESCRIPTION OF THE INVENTION

Figure 1:
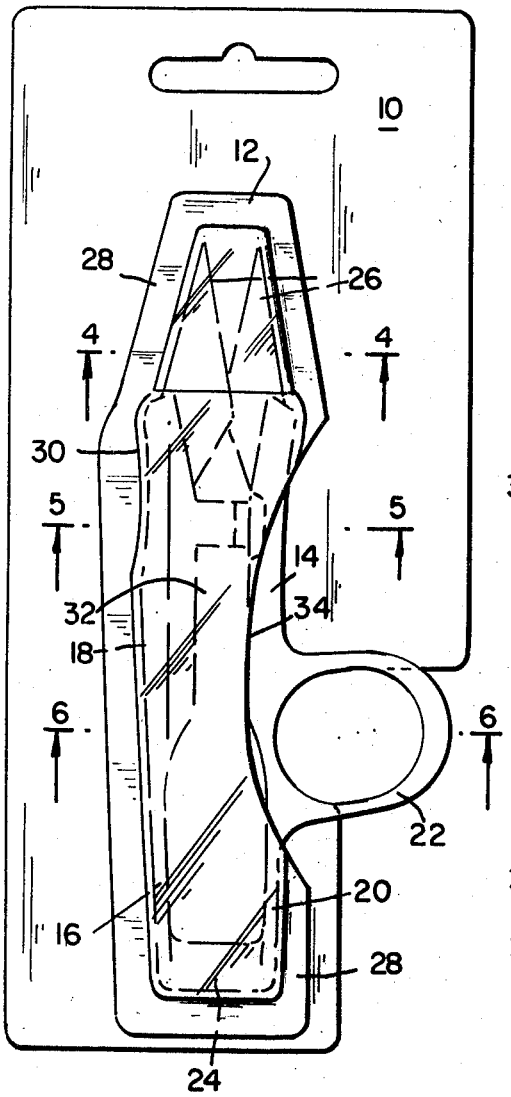
FIG. 1 is a front view of the blister packages of the invention as applied to a pair of snippers, the snippers being in the open position.
Figure 3:
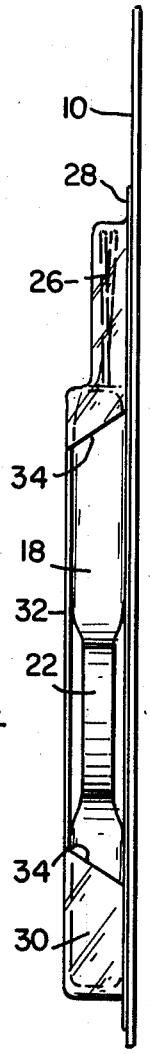
FIG. 3 is a side view of FIG. 1.

Referring to the drawings, the display card 10 has applied to it by pressure-adhesive means a transparent flexible, generally elongated plastic blistered covering 12 which surrounds and holds in place a pair of snipper-type scissors 14. The snippers shown have plastic-covered handles 16.

The handles are generally U-shaped with a first straight side 18 and a second side 20 formed with an oval or near-circular finger or thumb loop 22. The two sides are movably joined by a short bridge-piece 24. The arrangement is such, that when the user place a thumb or finger through loop 22 and applies a squeezing pressure on sides 18, 20, the blades 26 mounted at the free ends of sides 18,20 are moved into the "closed" position shown in FIG. 2.

Figure 4:
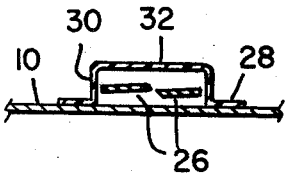
FIGS. 4, 5 and 6 are sectional views taken on lines 4—4, 5—5 and 6—6 in FIG. 1 respectively.
Figure 5:
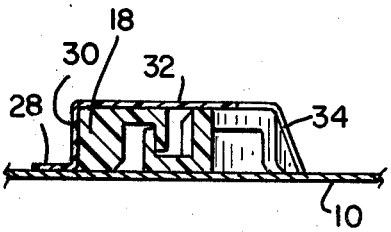
Figure 6:
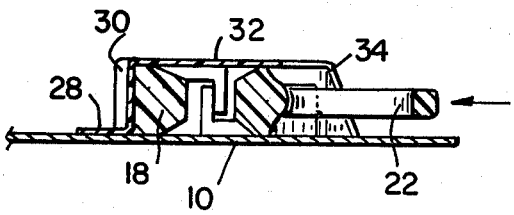

The plastic blister 12 has a rim 28 running practically around its entire periphery. The rim 28 is formed by the edge of the plastic being bent at right angles to the upstanding side 30 of the blister. By this arrangement, the blister is given a generally U-shaped cross-section as clearly visible in FIGS. 4, 5 and 6, the width of the horizontal limb 32 of the "U" varying at different portions of the blister.

Figure 2:
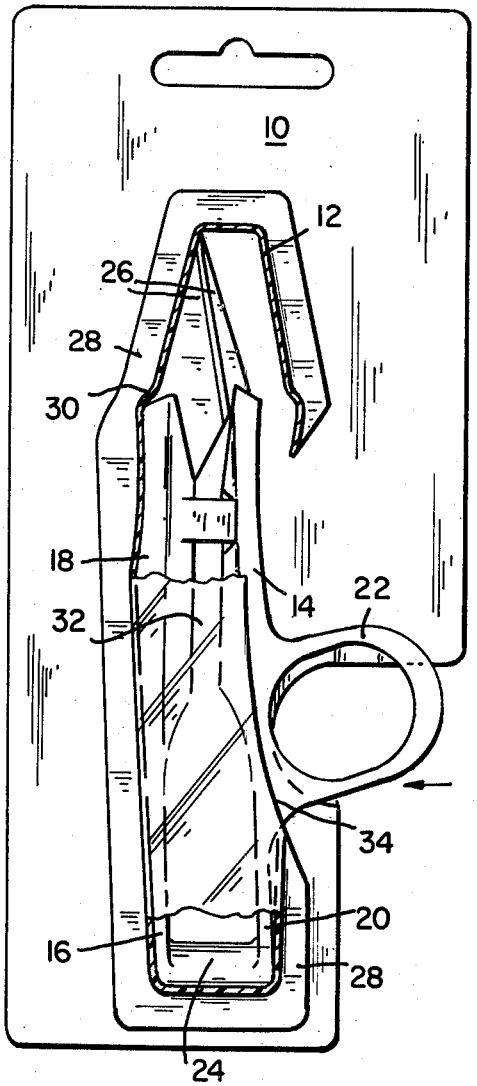
FIG. 2 is a similar figure with the snippers in the closed position, and showing the blister partly broken away.

In FIGS. 1 and 2, the upper part of the blister housing the blades 26 is generally trapezoidal.

At the top, the width of this part of the blister corresponds to the distance between the blade tips in the "open" position so that the sides of the blades rest comfortably between the tapered sides of the blister.

The lower part of the blister generally conforms to the U-shaped handle of the snippers. As shown in FIG. 1 the sides of the blister at the area of the bridge piece 24 closely embrace the sides of the snippers 18. In this way, this end of the handle of the snipper is securely locked in place. The loop 22 on the other hand projects outside the blister which is formed with an arcuate cut-out 34 at the midway portion of the blister.

The exact shape of the cut-out which has been described as arcuate is not material as its sole purpose is to allow the "thumb" or "finger" loop to stick out from the blister and permit its being moved in the plane of the display card 10, in the direction of arrow A of the drawings, by the purchaser's thumb or finger which has been inserted in loop 22.

Although the shape of the cut-out is not material, the arcuate or part-elliptical shape as shown is preferred as it is aesthetically of pleasing appearance.

By virtue of the arcuate cut-out 34, the inside of the blister is open to the atmosphere and it will be understood that the package of the invention can only usefully be applied to snippers with stainless steel blades which do not rust or otherwise deteriorate when exposed to air.

It will be seen that by the arrangement of the invention, the prospective purchaser can insert his thumb or finger into the loop so as to obtain a "feel" of the handles and functionally move the snipper blades back and forth within the confines of the blister.

What we claim is:

1. A functional blister package for snipper-type scissors having a springy U-shaped end and free movable ends carrying pointed diamond-shaped blades and an integral thumb loop formed on one limb of the U-shaped end comprising a display card, a cut-out portion in the display card to allow free access to the thumb loop, a transparent, flexible, blistered elongated covering, an outwardly bent edge on the transparent covering facing the display card and made to adhere to said card, the transparent covering being generally shaped to conform to the shape of the snippers, one end of the generally elongated transparent covering being shaped to substantially enclose and lock in place the U-shaped end of the snipper, the other end of the transparent covering being trapezoidal in shape to permit restricted movement of the pointed blades which in their open position rest against the sides of the trapezoidal area of the said transparent covering and a cut-out portion in the transparent blistered covering substantially midway between said free ends and said U-shaped end allowing the thumb loop of the snipper to project outside so as to permit the snippers to be grasped and moved back and forth by a prospective purchaser in the plane of the display card.

* * * * *